US012545478B2

(12) United States Patent
Tamarindo et al.

(10) Patent No.: US 12,545,478 B2
(45) Date of Patent: Feb. 10, 2026

(54) CLOSURE FOR A SPOUT IN A THIN-WALLED PACKAGE

(71) Applicant: GUALA PACK S.P.A., Castellazzo Bormida (IT)

(72) Inventors: Stefano Tamarindo, Castellazzo Bormida (IT); Alberto Buzzi, Castellazzo Bormida (IT); Riccardo Zammori, Castellazzo Bormida (IT)

(73) Assignee: Guala Pack S.P.A., Castelazzo Bormida (IT)

( * ) Notice: Subject to any disclaimer, the term of this patent is extended or adjusted under 35 U.S.C. 154(b) by 204 days.

(21) Appl. No.: 18/041,097

(22) PCT Filed: Aug. 6, 2021

(86) PCT No.: PCT/IB2021/057266
§ 371 (c)(1),
(2) Date: Feb. 9, 2023

(87) PCT Pub. No.: WO2022/034459
PCT Pub. Date: Feb. 17, 2022

(65) Prior Publication Data

US 2023/0303294 A1 Sep. 28, 2023

(30) Foreign Application Priority Data

Aug. 11, 2020 (IT) ..... 102020000019939

(51) Int. Cl.
*B65D 41/34* (2006.01)
*B65D 55/16* (2006.01)
(Continued)

(52) U.S. Cl.
CPC ..... *B65D 41/3447* (2013.01); *B65D 55/16* (2013.01); *B65D 75/5883* (2013.01);
(Continued)

(58) Field of Classification Search
CPC ..... B65D 75/5883; B65D 2401/30; B65D 41/02; B65D 41/0471; B65D 41/0485; B65D 41/3447; B65D 41/32
(Continued)

(56) References Cited

U.S. PATENT DOCUMENTS 2,961,119 A * 11/1960 Leach ..... B65D 55/16 220/291
4,339,056 A * 7/1982 Berkstresser, Jr. .... B65D 55/16 220/375

(Continued)

FOREIGN PATENT DOCUMENTS

JP 2007204124 A 8/2007

OTHER PUBLICATIONS

International Search Report for International Patent Application No. PCT/IB2021/057266, mailed Nov. 5, 2021.

*Primary Examiner* — Steven A. Reynolds
*Assistant Examiner* — Prince Pal
(74) *Attorney, Agent, or Firm* — Armstrong Teasdale LLP

(57) ABSTRACT

A closure assembly for a package with a thin-walled flexible pouch for containing fruit juices and purees, yoghurt, and energy drinks is provided. The closure assembly has a spout assembly and a closure having a guarantee seal. The guarantee seal has a guarantee ring, a guarantee band, a plurality of breakable bridges, a first attachment portion, and a second attachment portion. In an open configuration, the guarantee band forms a strap that keeps the cap fastened to the guarantee ring and has a length such that, in a use configuration in which the guarantee band is stretched, the second attachment portion is arranged axially below a connection portion of the spout assembly. The guarantee seal has a breakable segment which, in the open configuration, is broken.

11 Claims, 9 Drawing Sheets

(51) Int. Cl.
*B65D 75/58* (2006.01)
*B65D 85/72* (2006.01)

(52) U.S. Cl.
CPC ..... *B65D 85/72* (2013.01); *B65D 2401/30* (2020.05); *B65D 2575/586* (2013.01)

(58) Field of Classification Search
USPC ..... 215/252, 250, 251; 220/375
See application file for complete search history.

(56) References Cited

U.S. PATENT DOCUMENTS 4,343,408 A * 8/1982 Csaszar ..... B65D 41/3442 215/258
4,436,212 A * 3/1984 Alejandro Llera ..... B65D 41/3442 215/258
4,549,667 A * 10/1985 Dullabaun ..... B65D 41/3447 215/253
4,550,843 A * 11/1985 Nolan ..... B65D 41/3452 215/321
4,567,993 A * 2/1986 Albrecht ..... B65D 41/3447 215/258
4,732,289 A * 3/1988 Granat ..... B65D 41/3433 215/901
4,741,447 A * 5/1988 John ..... B65D 41/3447 215/DIG. 1
4,744,480 A * 5/1988 Luch ..... B65D 41/3447 215/901
4,753,358 A * 6/1988 Virca ..... B65D 55/16 215/230
4,756,438 A * 7/1988 Ryder ..... B65D 41/3447 215/252
4,878,589 A * 11/1989 Webster ..... B65D 41/3447 215/DIG. 1
4,904,435 A * 2/1990 Babcock ..... B26F 1/20 264/154
4,909,404 A * 3/1990 Rozenberg ..... B65D 41/3409 215/256
4,923,073 A * 5/1990 Wilde ..... B65D 41/3428 215/252
4,989,740 A * 2/1991 Vercillo ..... B65D 55/0863 215/318
5,097,974 A * 3/1992 Rozenberg ..... B65D 41/3442 215/256
5,215,204 A * 6/1993 Beck ..... B65D 55/16 215/258
5,246,125 A * 9/1993 Julian ..... B65D 41/3447 215/252
5,402,901 A * 4/1995 Carvalheiro ..... B29C 45/4407 215/252
5,755,346 A * 5/1998 Ekkert ..... B65D 41/3447 215/901
5,848,686 A * 12/1998 Dean ..... B65D 5/5213 206/215
5,971,182 A * 10/1999 Berge ..... B65D 41/3428 215/258
6,279,774 B1 * 8/2001 Clute ..... B65D 43/0256 220/780
6,325,227 B1 * 12/2001 Ekkert ..... B65D 41/3447 215/258
6,931,821 B2 * 8/2005 Wong ..... B65D 55/16 215/250
D762,117 S * 7/2016 Joseph ..... D9/434
9,511,905 B2 * 12/2016 Tsujiguchi ..... B65D 41/3447
9,751,677 B2 * 9/2017 Fiere ..... B65D 51/18
D799,322 S * 10/2017 Tamarindo ..... D9/451
10,421,593 B1 * 9/2019 Litten ..... B65D 55/16
10,894,642 B2 * 1/2021 Cerveny ..... B65D 47/0804
11,059,633 B2 * 7/2021 Gosling ..... B65D 47/0838
2001/0030164 A1 * 10/2001 Corvaglia ..... B65D 41/3447 215/252
2005/0045578 A1 * 3/2005 Schwarz ..... B65D 41/3428 215/252
2008/0073348 A1 3/2008 Pritikin et al.
2008/0135513 A1 * 6/2008 Umenaka ..... B65D 41/3409 383/204
2008/0197135 A1 * 8/2008 Berman ..... B65D 41/34 215/276
2008/0272086 A1 * 11/2008 Granger ..... B65D 41/348 215/354
2011/0210122 A1 * 9/2011 Benoit-Gonin .... B65D 75/5883 220/277
2012/0261421 A1 * 10/2012 Yourist ..... B65D 55/16 264/531
2012/0305564 A1 * 12/2012 Hayashi ..... B65D 41/3428 220/288
2013/0233874 A1 * 9/2013 Sundnes ..... B65D 43/0216 220/834
2015/0060457 A1 * 3/2015 Van Der Molen ... B65D 41/325 53/426
2015/0251795 A1 * 9/2015 Tsui ..... B65D 1/0292 215/379
2016/0067147 A1 * 3/2016 Davis ..... B65D 51/1622 220/303
2016/0122095 A1 * 5/2016 Berge ..... B65D 55/022 222/566
2016/0159635 A1 * 6/2016 Davis ..... B67D 3/0051 141/366
2017/0066571 A1 * 3/2017 Panec ..... B65D 47/122
2017/0121084 A1 * 5/2017 Moorehouse ..... B65D 35/44
2017/0354289 A1 * 12/2017 Marina ..... A47J 31/407
2018/0105332 A1 * 4/2018 Ohkubo ..... B65D 75/5883
2018/0170626 A1 * 6/2018 Kwon ..... B65D 41/3404
2018/0201415 A1 * 7/2018 Berge ..... B65D 41/3428
2018/0265259 A1 * 9/2018 Berge ..... C08L 101/00
2019/0106251 A1 * 4/2019 Sterling ..... B65D 41/3447
2019/0133356 A1 * 5/2019 Kessler-Seed ..... A61J 11/007
2019/0144189 A1 * 5/2019 Van Der Molen ..... B65D 75/5883 383/80
2019/0168924 A1 * 6/2019 Tamarindo ..... B65D 41/3442
2019/0177044 A1 * 6/2019 Beringer ..... B65D 47/0838
2020/0017260 A1 * 1/2020 Migas ..... B65D 43/162
2020/0255203 A1 * 8/2020 Roemer ..... B65D 75/5883
2020/0399036 A1 * 12/2020 Dai ..... B65D 41/325
2021/0039840 A1 * 2/2021 Benoit-Gonin ..... B65D 55/16
2021/0206537 A1 * 7/2021 Lamoureux ..... B65D 55/16
2022/0002040 A1 * 1/2022 Buzzi ..... B65D 47/143
2022/0024650 A1 * 1/2022 Tamarindo ..... B65D 41/3428
2022/0055804 A1 * 2/2022 Khattar ..... B65D 55/16
2022/0097928 A1 * 3/2022 Graux ..... B65D 47/0809
2022/0153483 A1 * 5/2022 Lässer ..... B65D 55/16
2022/0161982 A1 * 5/2022 Tamarindo ..... B65D 75/008
2022/0204228 A1 * 6/2022 Bassi ..... B65D 55/16
2022/0250816 A1 * 8/2022 Tamarindo ..... B65D 41/3447
2022/0371795 A1 * 11/2022 Naumann ..... B65D 41/3423
2023/0087314 A1 * 3/2023 Gosling ..... B65D 41/3423 215/252
2023/0089722 A1 * 3/2023 van den Hoonaard ..... B65D 41/3409 215/252
2023/0257180 A1 * 8/2023 Tamarindo ..... B65D 55/026 222/92
2023/0303294 A1 * 9/2023 Tamarindo ..... B65D 75/5883
2024/0025095 A1 * 1/2024 Scherer ..... B65D 55/16
2024/0101324 A1 * 3/2024 Gosling ..... B65D 55/16
2024/0239564 A1 * 7/2024 De Ruiter ..... B65D 47/14
2024/0239566 A1 * 7/2024 De Ruiter ..... B65D 75/5883

* cited by examiner 10
12
14a
14b
16
20
22
24
25'
25"
26a
26b
26c
26d
26e
26'
26"
30
x 80
82
58
86
56
84
66

CLOSURE FOR A SPOUT IN A THIN-WALLED PACKAGE

CROSS-REFERENCE TO RELATED APPLICATION

This application is a National Stage Application of International Patent Application No. PCT/IB2021/057266, having an International Filing Date of Aug. 6, 2021, which claims priority to Italian Patent Application No. 102020000019939, filed Aug. 11, 2020, the entire contents of which are hereby incorporated by reference herein.

FIELD OF THE INVENTION

The present invention is in the field of thin-walled packages provided with a spout, usually referred to as a "pouch". In particular, the present invention refers to a closure for a spout of said package.

BACKGROUND OF THE INVENTION

Said packages are primarily used to contain fruit juices, yoghurt, fruit puree, energy drinks, and similar products for children. These packages have become very popular, due to their compact size, great practicality of use, and playful aspect linked to the use of the spout, which attracts the attention of children. Several hundred million units are produced and sold every year.

Typically, spout closures, made of plastic, comprise a cap and a guarantee seal, which comprises a guarantee ring joined to the cap by a plurality of breakable bridges. When the cap is unscrewed for the first time, the bridges break, separating the cap from the guarantee ring and making the first opening apparent.

Recently, research and development efforts of manufacturing companies have focused on constructing a closure with a guarantee seal in which, even after the first opening, the cap remains attached to the guarantee ring to prevent it from being lost in the environment.

SUMMARY OF THE INVENTION

It is the object of the present invention to make a closure for a spout of a thin-walled package that meets the aforesaid requirements and is particularly comfortable to use.

This object is achieved by a closure as described and claimed herein. Additional advantageous embodiments of the present invention are also described.

BRIEF DESCRIPTION OF THE FIGURES

The features and advantages of the closure according to the present invention will become apparent from the following description, given by way of non-limiting example according to the figures in the accompanying drawings, wherein.

DETAILED DESCRIPTION

Figures 1A, 1B, 1C, 1D:
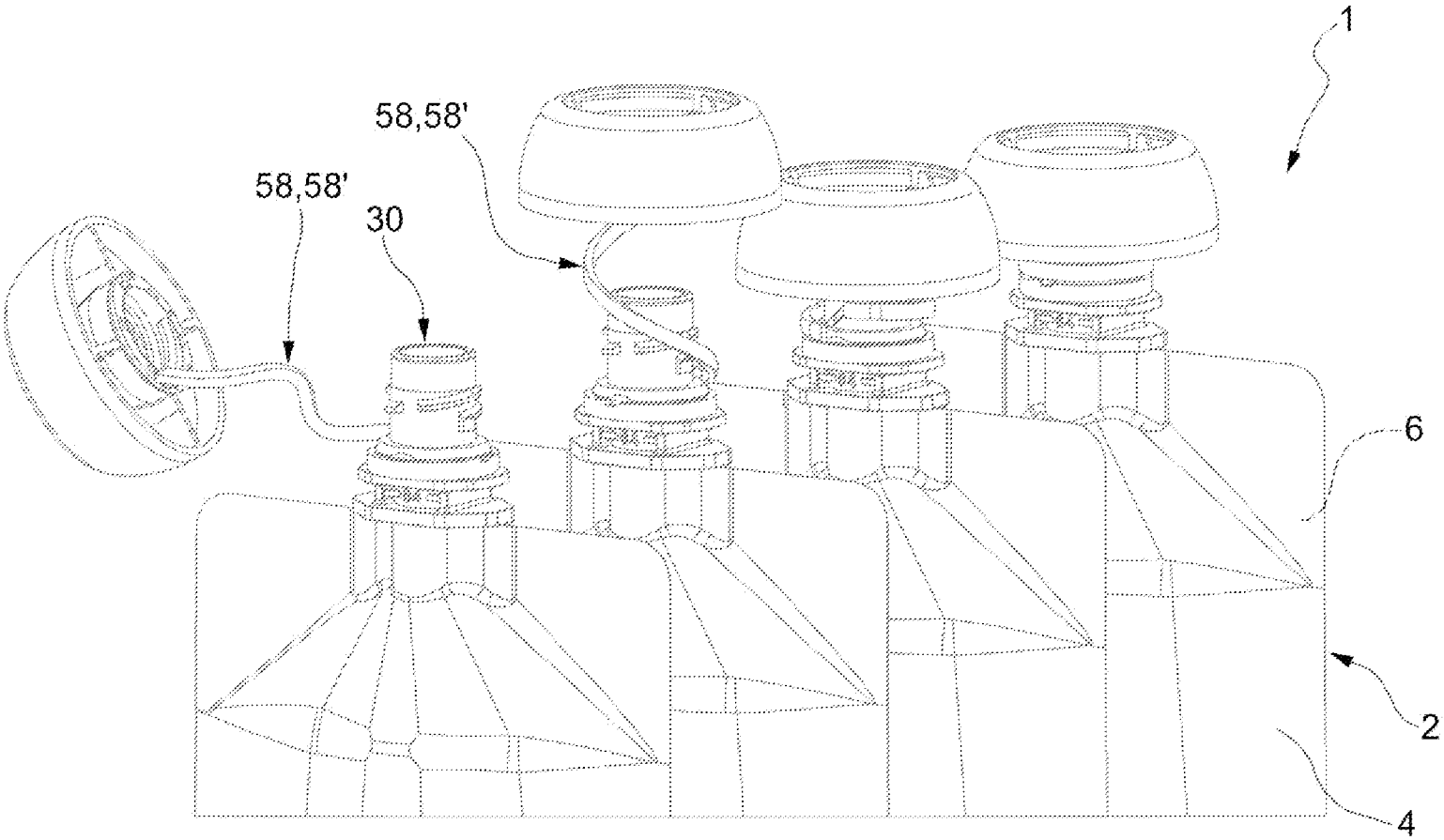
FIG. 1*a* through 1*d* show a package according to one embodiment of the present invention, in various configurations.
Figures 2A, 2B, 2C, 2D, 2E, 3A, 3B, 3C, 3D, 3E, 4A, 4B, 4C, 4D, 4E:
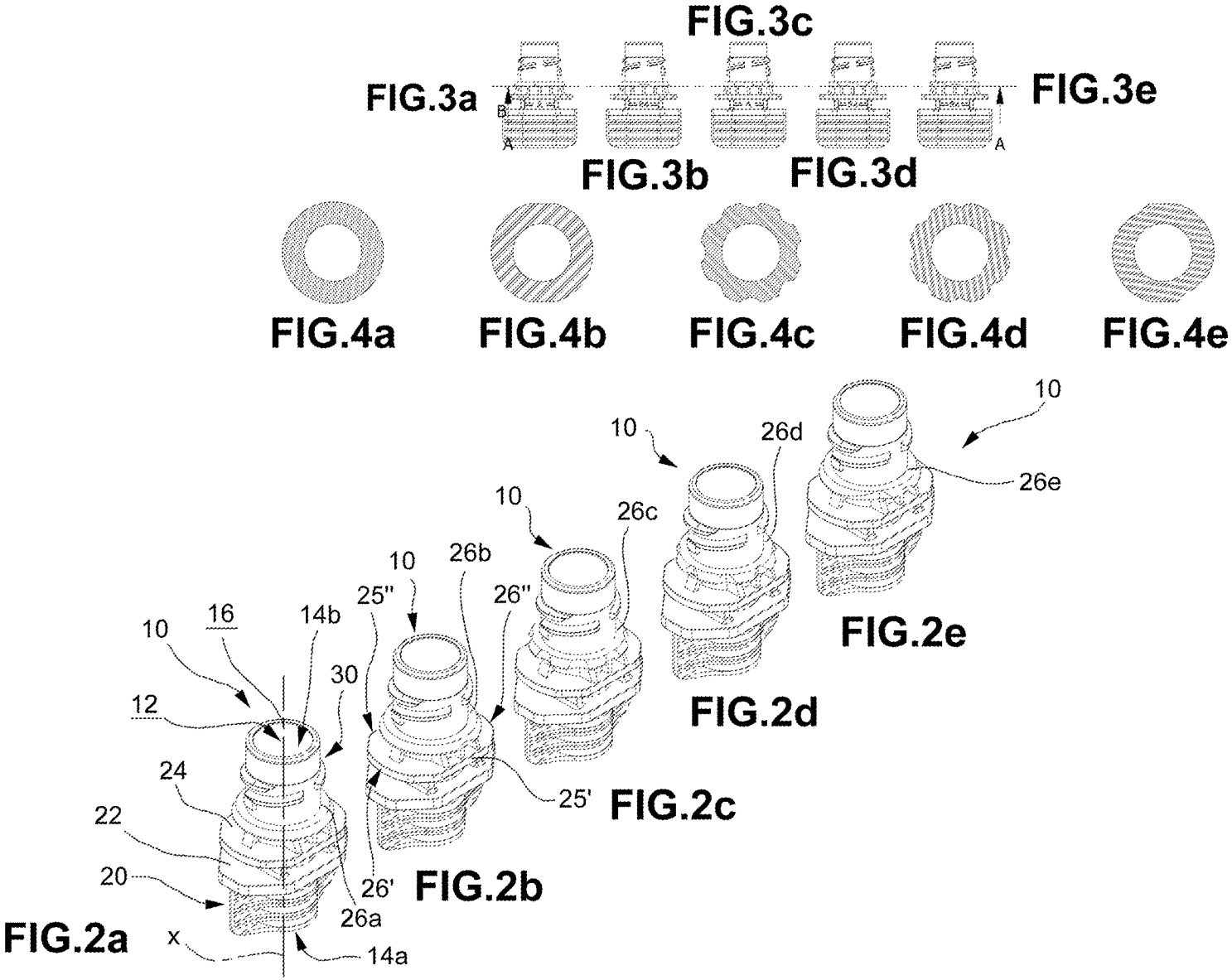
FIG. 2*a* through 2*e* and 3*a* through 3*e* depict a spout assembly of the package, according to various embodiments.
FIG. 4*a* through 4*e* illustrate the cross section of an engagement plate of the spout assembly, according to various embodiments.
Figure 6:
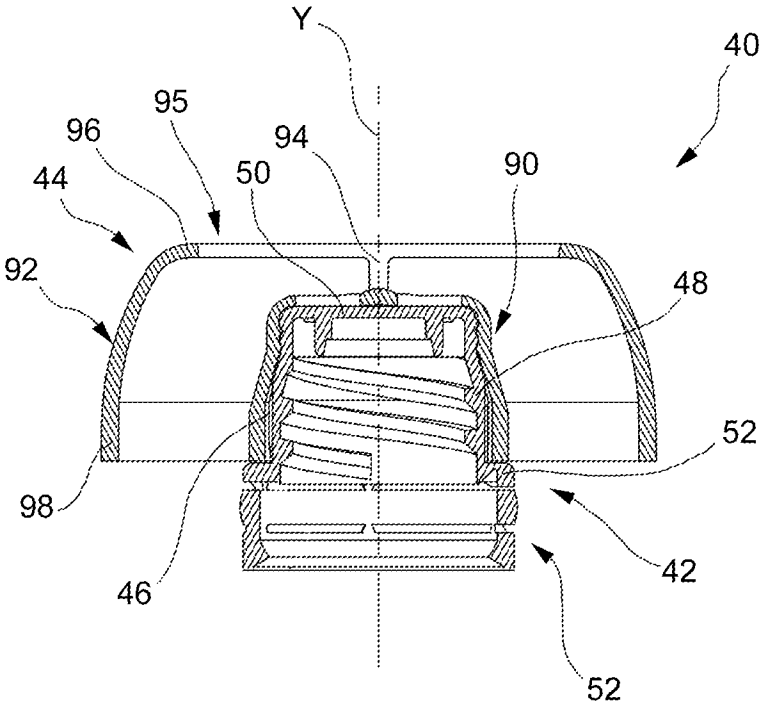
FIG. 6 is a longitudinal cross section of the closure in FIG. 5.
Figure 5:
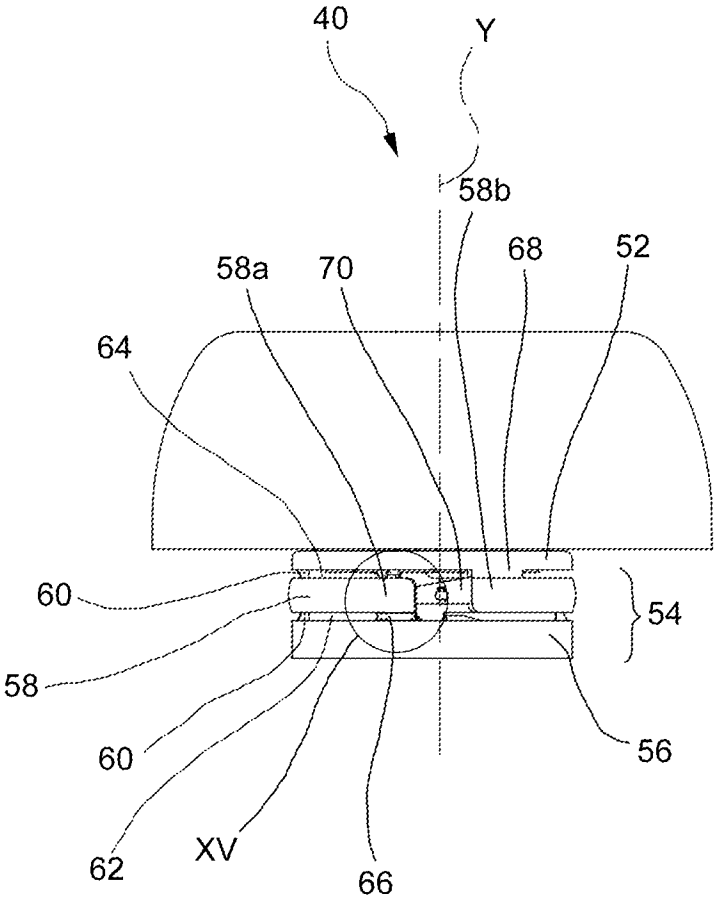
FIG. 5 depicts a closure according to an embodiment of the present invention.

In reference to the figures in the attached drawings, 1 has been used to indicate a thin-walled package, usually referred to as a "pouch". The package 1 comprises a pouch 2 for containing the product, comprising a front wall 4 and a rear wall 6, facing each other, made of a flexible, single-layer or multi-layer film. Along the side edges, the walls 4, 6 are welded together or, in a variant embodiment, sides are provided made of flexible film and welded to the walls 4, 6.

The package 1 further comprises a spout assembly 10, typically made in one piece of plastic material by injection molding. The spout assembly 10 has an internal spout duct 12 extending from a lower end 14*a*, intended to be contained in the pouch 2, to an upper end 14*b* in which is found a mouth 16 for dispensing product along a spout axis X.

The spout assembly 10 comprises a connection portion 20, referred to as a "weld boat," intended to be hermetically applied to the pouch 2, between the top edges of the walls 4, 6, for example, by welding. The connection portion 20 is axially delimited by a first plate 22 orthogonal to the spout axis X.

A second plate 24 of the spout assembly 10, also orthogonal to the spout axis X, is spaced axially from the first plate 22. The second plate 24 has two opposing straight edges 25', 25", connected by two leading edges 26', 26", which are, for example, arched.

The spout assembly 10 further comprises a spout extending axially from the second plate 24 and ending with the mouth 16.

The spout assembly 10 further comprises an engagement plate 26*a*-26*e*, which is orthogonal to the spout axis X and projecting radially outward from the outer side surface of the spout 30. The projection of the engagement plate template 26*a*-26*e* along the spout axis X onto the second plate 24 is entirely contained within said second plate 24, so as not to interfere with the movement of the packages along the filling lines.

In an imaginary plane orthogonal to the spout axis X, said engagement plate 26*a*-26*e* has a cross section having various shapes (FIG. 4*a* through 4*e*): cylindrical circular crown shape; cylindrical circular crown chamfered by straight portions at the straight edges 25', 25" of the second plate 24;

grooved with arched edges; grooved with straight edges; cylindrical circular crown chamfered by mixed straight and arched segments.

Between the engagement plate 26*a*-26*e* and the second plate 24, a ring seat 100 is obtained, which is discussed below.

The package 1 further comprises a closure 40 applicable to the spout assembly 10.

According to a preferred embodiment, the closure 40 comprises a cap assembly 42 and an over-cap 44, which are made separately and joined together.

The cap assembly 42 comprises a cap 46, having a central cap axis Y and comprising an annular, internally threaded cap wall 48, a cap base 50 which closes the cap wall 48 at one end, and a cap flange 52, radially projecting externally from the cap wall 48, on the other end.

The cap assembly 42 further comprises a guarantee seal 54 comprising a guarantee ring 56, a guarantee band 58, and a plurality of breakable bridges 60 joining the guarantee ring 56 to the guarantee band 58 and the guarantee band 58 to the cap flange 52.

The guarantee band 58, which extends between an initial portion 58*a* and an end portion 58*b*, is wound about the cap axis Y in a circumferential pattern, whereby, in an unbroken seal configuration, the initial portion 58*a* is circumferentially opposite the end portion 58*b* and spaced apart therefrom.

The guarantee band 58 is also superimposed on the guarantee ring 56, from which it is axially separated by a first separation line 62, along which some bridges 60 are arranged; the cap flange 52 is in turn axially superimposed on the guarantee band 58, from which it is axially separated by a second separation line 64, along which some bridges 60 are arranged.

The guarantee seal 54 further comprises a first attachment portion 66, which is more resistant than the bridges 60 and joins the guarantee band 58, and in particular the initial portion 58*a* thereof, to the guarantee ring 56. The guarantee seal 54 further comprises a second attachment portion 68, which is more resistant than the bridges 60 and joins the guarantee band 58, and in particular the end portion 58*b* thereof, to the cap flange 52.

Moreover, according to an embodiment, the guarantee seal 54 comprises a predominantly circumferentially extending breakable segment 70, which joins the initial portion 58*a* of the band 58 with the end portion 58*b*.

Figure 7C:
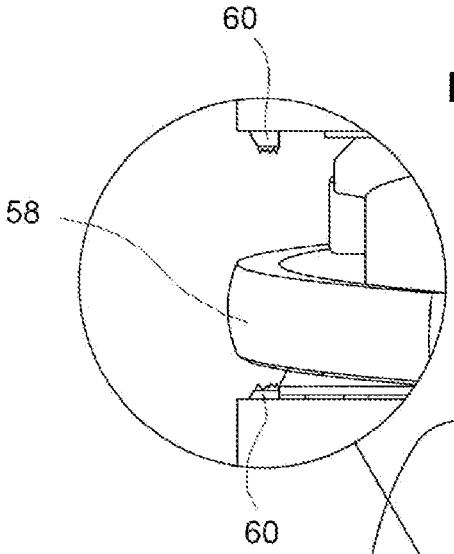
FIG. 7*c* is an enlargement of a box in FIG. 7*a*, highlighting breakable bridges of the guarantee seal.
Figure 7A:
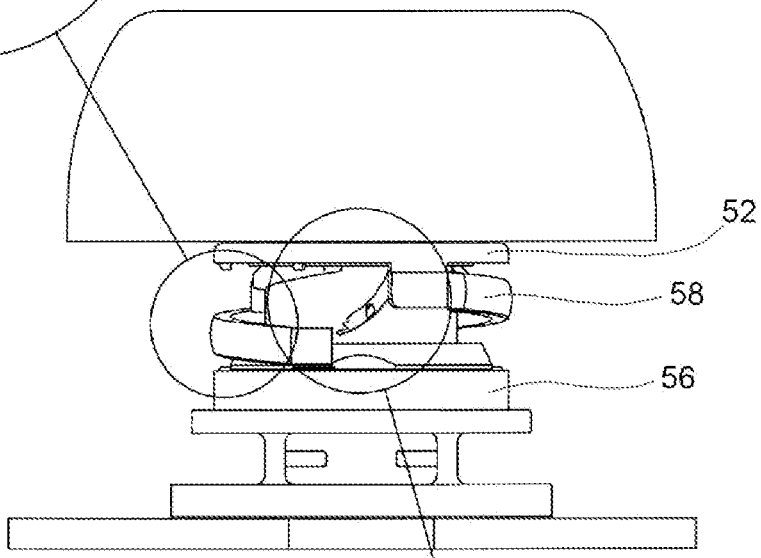
FIG. 7*a* shows a closure assembly in an initial open configuration.
Figure 7B:
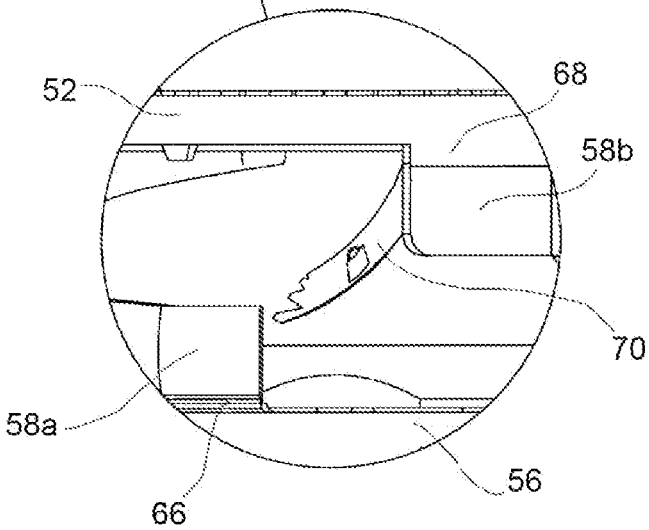
FIG. 7*b* is an enlargement of a box in FIG. 7*a*, showing a breakable segment of the guarantee seal.
Figures 8A, 8B, 8C, 8D, 9A, 9B, 9C, 9D:
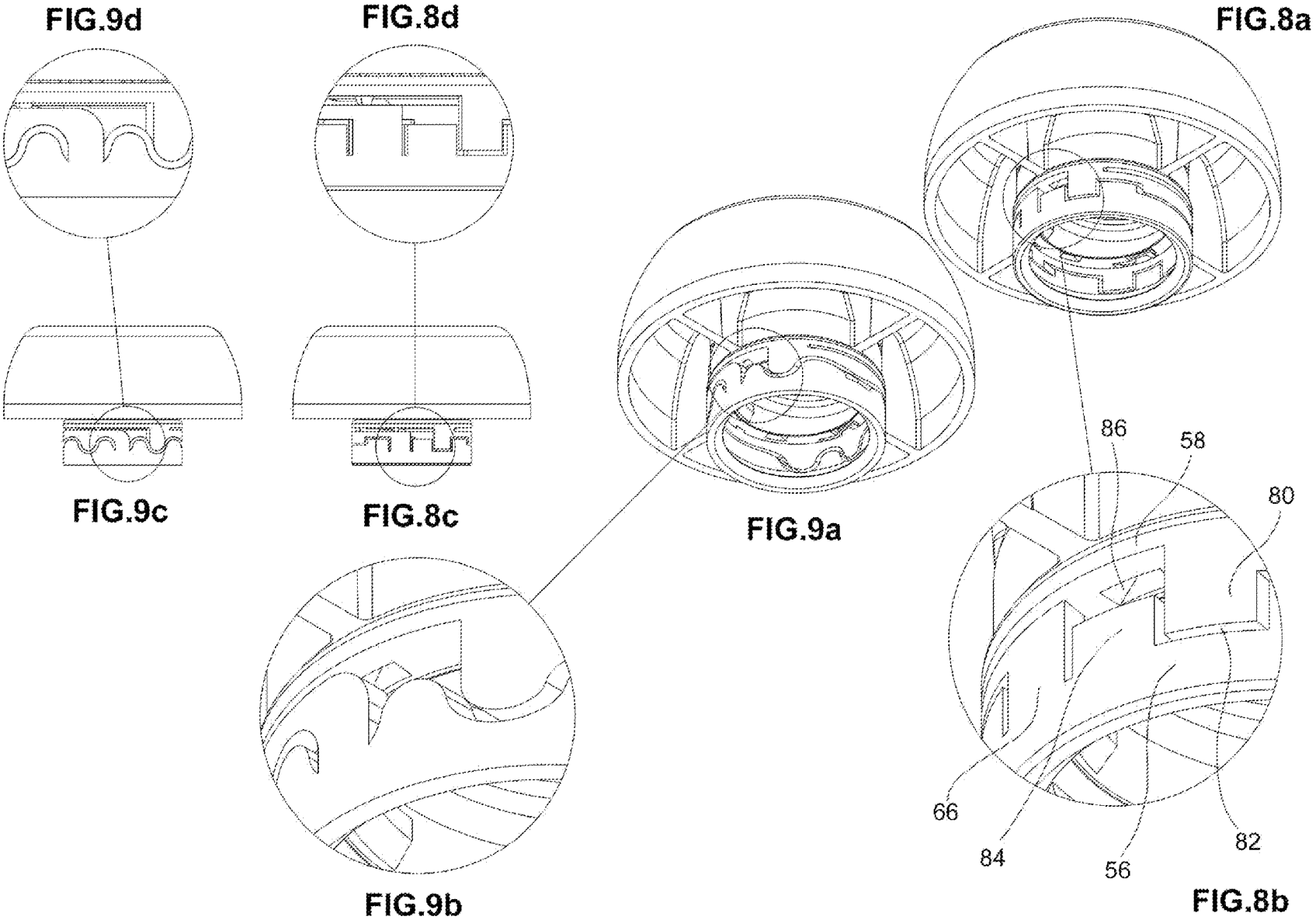
FIG. 8*a* through 8*d* depict a closure according to another embodiment of the invention.
FIG. 9*a* through 9*d* depict a closure according to yet another embodiment of the invention.

Preferably, the breakable segment 70 is configured to encounter a preferential breakage at the initial portion 58*a*, whereby the part remaining after the first opening remains attached to the end portion 58*b* (FIGS. 7*a* and 7*b*). To this end, the breakable segment 70 has a cross section with decreasing resistance from the end portion 58*b* to the initial portion 58*a*.

Preferably, moreover, the bridges 60 are configured to preferentially break at the guarantee band 58, whereby any residual protrusions remaining after the first opening remain attached to the guarantee ring 56 or cap flange 52, leaving the guarantee band 58 free of protrusions (FIGS. 7*a* and 7*c*).

For this purpose, the bridges 60 have a cross section with decreasing resistance from the guarantee band 58 toward the guarantee ring 56 or toward the cap flange 52, whereby, at the guarantee ring 56 or the cap flange 52, the cross section is small and particularly weak.

According to a preferred embodiment, the first separation line 62 has a fret (FIG. 8*a* through 8*d*) or wavy circumferential pattern (FIG. 9*a* through 9*d*), whereby the guarantee band 58 and the guarantee ring 56 interpenetrate axially, forming reliefs and respective indents.

For example, the guarantee band 58 has at least one axial relief 80, which corresponds to the respective axial indent 82 of the guarantee ring 56; according to a further example, the guarantee ring 56 has at least one axial relief 84 which corresponds to the respective axial indent 86 of the guarantee band 58.

Advantageously, when the closure 40 is first screwed to the spout assembly 10, the reliefs 80 of the guarantee band 58 thrust on the reliefs 84 of the guarantee ring 56, which act as circumferential abutments, dragging the guarantee ring 56 in rotation, thus avoiding the breakage of the bridges 60 between the guarantee band 58 and the guarantee ring 56.

According to an embodiment, the over-cap 44, preferably made of plastic material in one piece, for example by injection molding, comprises a shell 90 integral with the cap 46, for example so that it covers, at least partially, the outer surface of the cap wall 48.

The over-cap 44 further comprises an annular handle 92, radially spaced externally from the shell 90, and spokes 94 that make the handle 92 integral with the shell 90.

The handle 92 has a handle opening 95 at the top, i.e., on the side of the cap base 50, delimited by an opening edge 96 that surmounts the cap base 50 and is arranged axially spaced therefrom. On the other hand, the handle 92 has a lower perimeter edge 98 substantially coplanar with the lower edge of the cap wall 48, below which the cap flange 52 is located.

According to a variant embodiment, the closure 40 is made of plastic material in a single piece, for example by injection molding. In said variant, the shell is integrated with the cap.

Figure 10:
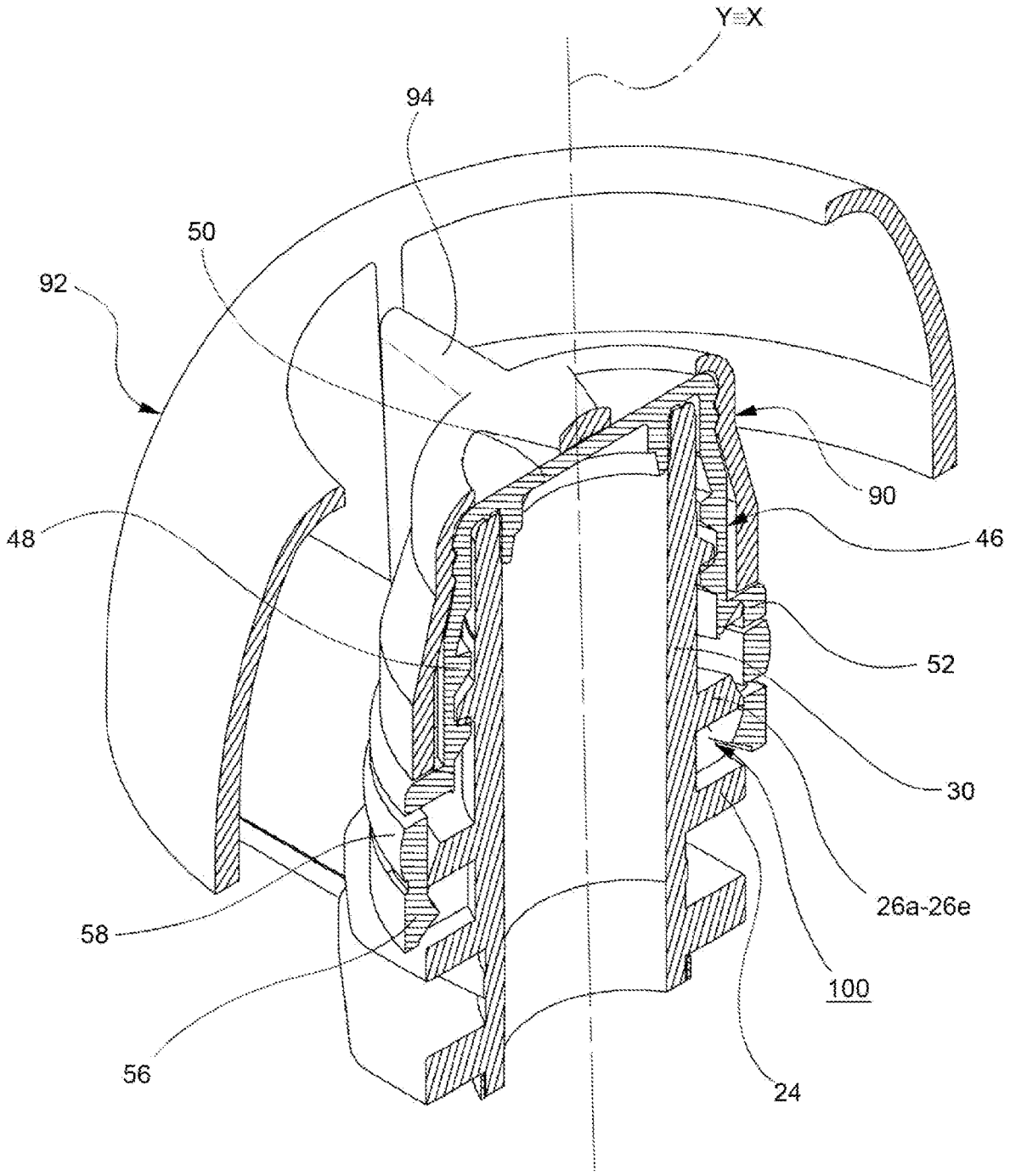
FIG. 10 is a cross section of a closure assembly according to an embodiment of the present invention.

Having applied the closure 40 to the spout assembly 10 (FIG. 10) by screwing the cap 46 to the spout 30, the guarantee ring 56 is at least partially received in the ring seat 100, which is impossible to be pulled out axially without damaging it. The guarantee band 58, on the other hand, is located outside of the ring seat 100, above the engagement plate 26*a*-26*e*.

In one embodiment, the guarantee ring 56 is freely rotatable in the ring seat 100; according to a further embodiment, locking means are provided to prevent or limit the free rotation of the guarantee ring 56 in the ring seat 100.

Upon unscrewing the closure 40 from the spout 30, the breakable segment 70 breaks, as do the bridges 60, so that after unscrewing, the guarantee band 58 takes the form of a strap 58', connected to the guarantee ring 56 by the first attachment portion 66 and to the cap 46, and in particular to the cap flange 52, by the second attachment portion 68 (FIG. 1*a* through 1*d*). The closure 40, although unscrewed from the spout 30, thus remains connected to the spout assembly 10 (open configuration).

Figure 11:
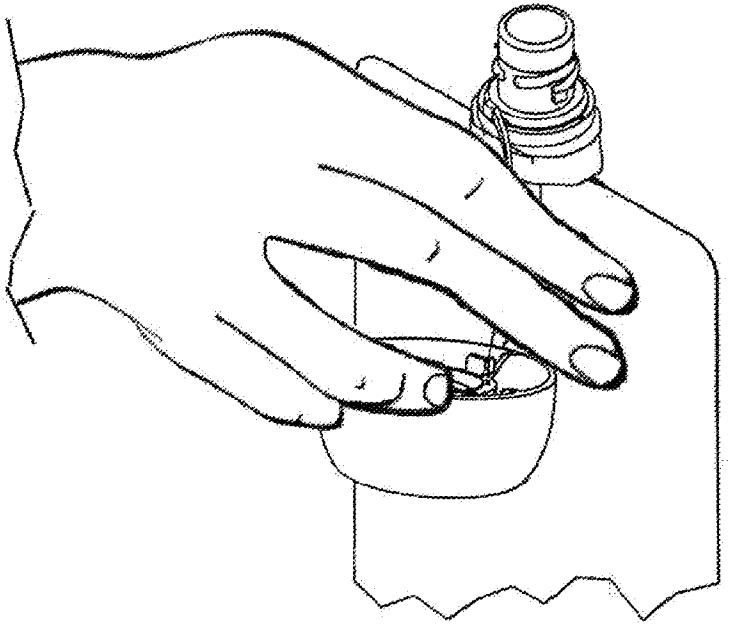
FIG. 11 through 14 illustrate a package according to the present invention in a use configuration.
Figure 12:
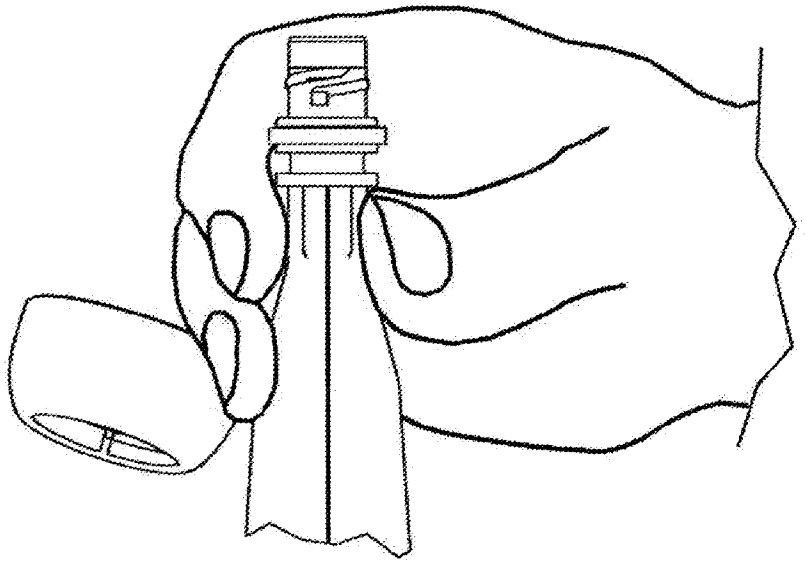

The guarantee band 58 is configured whereby in the open configuration, the handle 92 may be sufficiently far from the spout 30 so as to be able to place a user's fingers on the extended guarantee band 58, between the spout 30 and the handle 92, whereby the handle 92 is not in the way when using the spout (FIGS. 11 and 12).

Figure 14:
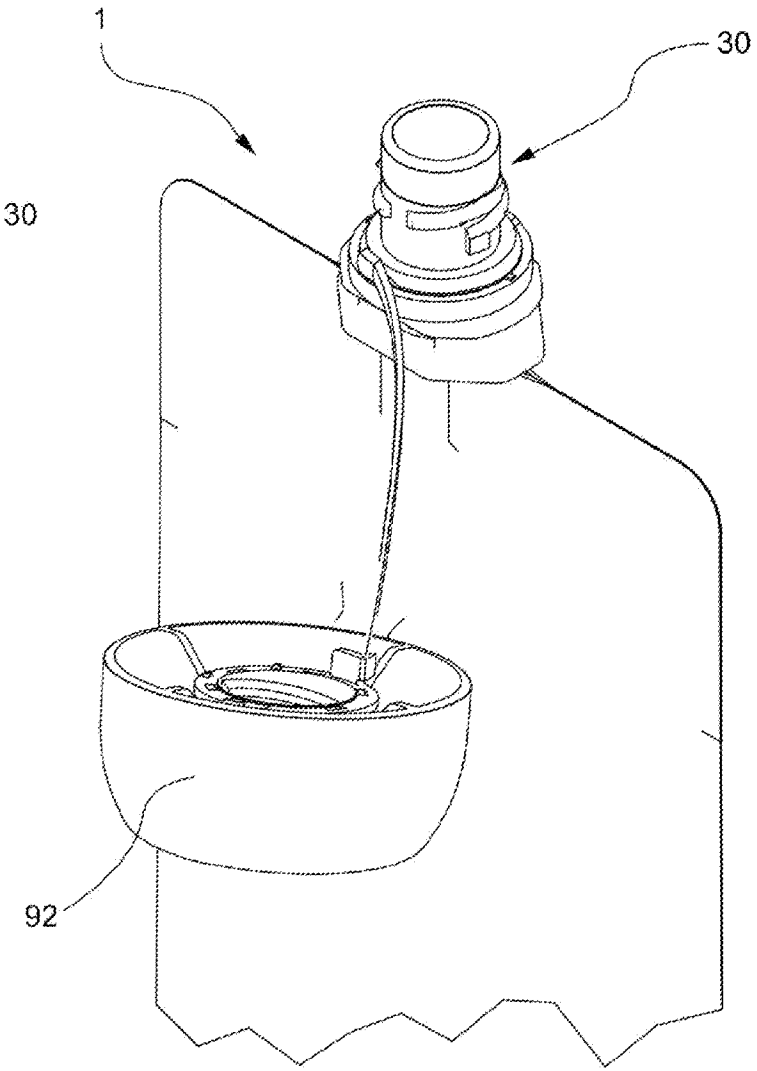
Figure 13:
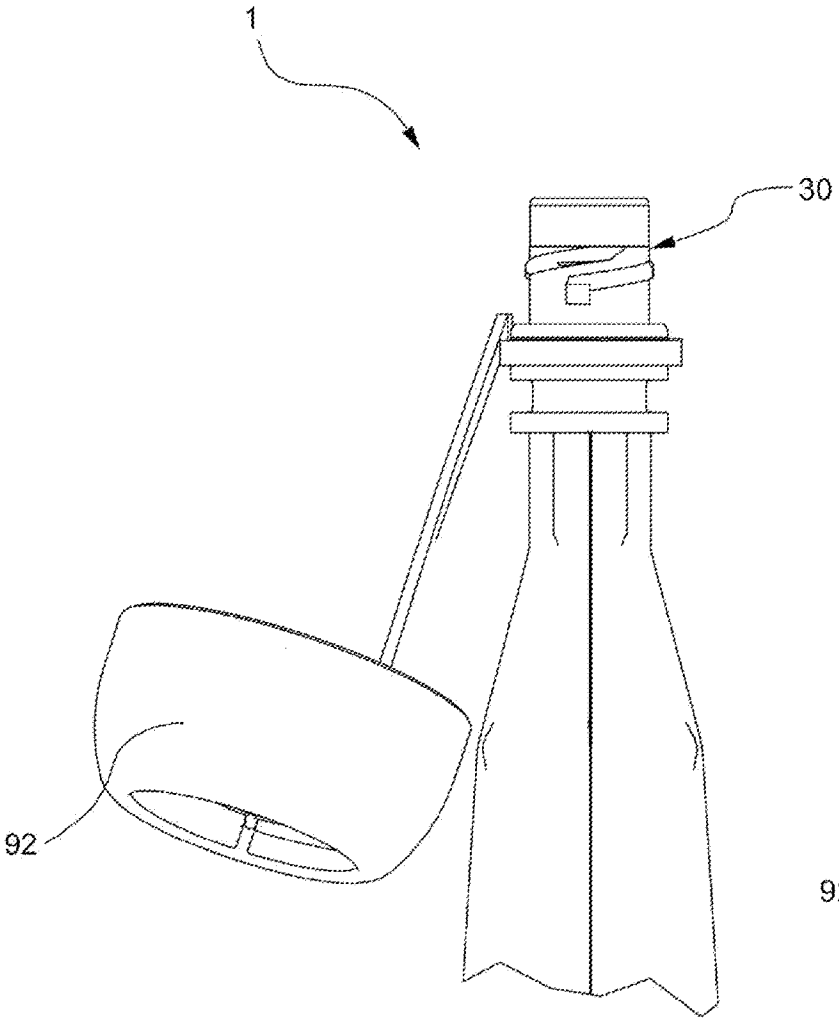

In particular, the guarantee band 58, when the package is in a use configuration in which it is substantially taut and straight, has a length such that the end portion 58*b*, to which the cap 46, and in particular the cap flange 52, is attached, is below the connection portion 20 of the spout assembly 10 (FIGS. 13 and 14). Because the end portion 58*b* is deformable, the handle 92 may be easily rotated and positioned out of the way.

Moreover, the attachment of the guarantee band 58 to the guarantee ring 56 and the cap 46 is configured whereby if the cap is pulled so that it causes a breakage and separation from the spout assembly, such breakage preferably occurs at the attachment between the guarantee band 58 and the guarantee ring 56.

Figure 15:
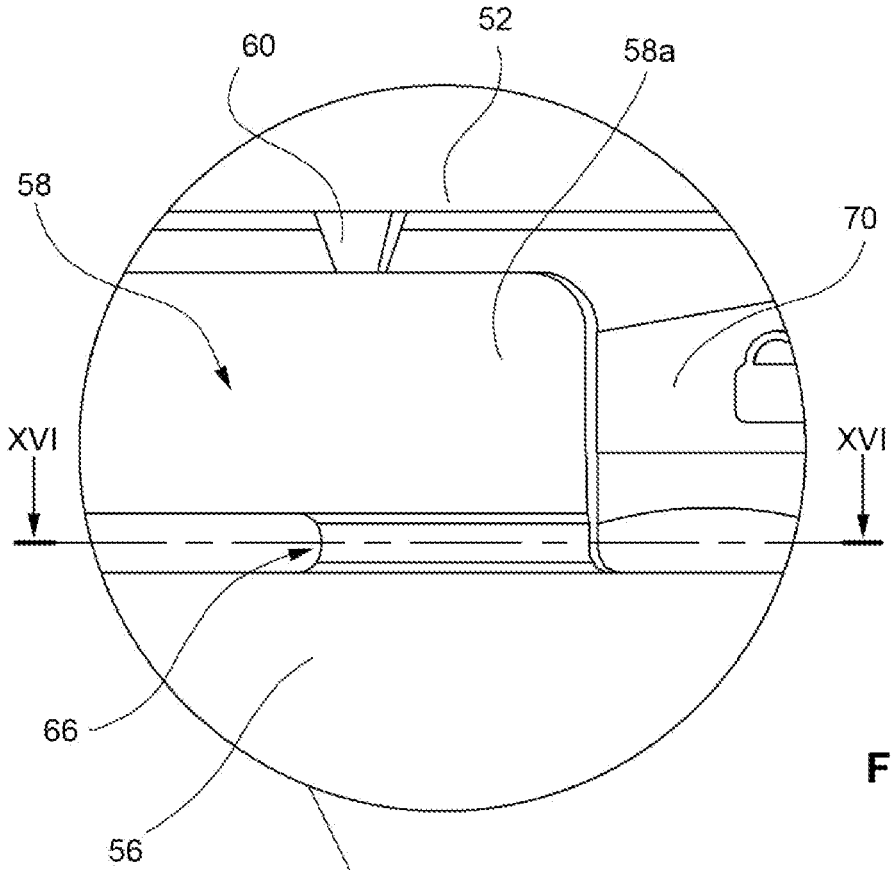
FIG. 15 is an enlargement of box XV in FIG. 5, showing a first attachment portion of the guarantee seal.
Figure 16:
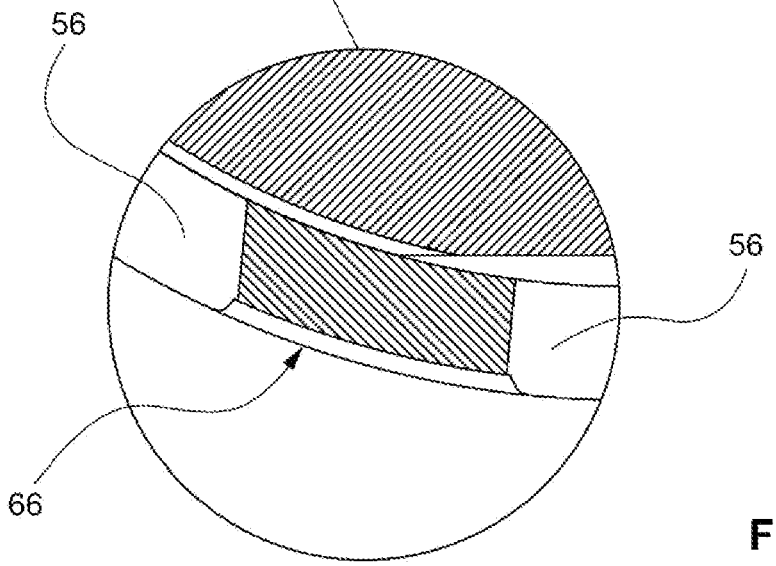
FIG. 16 is a cross section of the first attachment portion of FIG. 15, according to the cross-sectional plane XVI-XVI in FIG. 15.

To this end, the resistant cross section of the first attachment portion 66 is smaller than the resistant cross section of the second attachment portion 68 and the resistant cross section of the guarantee band 58 so as to cause preferential breakage in said region (FIGS. 15 and 16).

Innovatively, the closure according to the present invention achieves the aforementioned object, in that it meets the industry requirement of being provided with a guarantee seal, while at the same time allowing the cap and handle to remain fastened to the spout assembly even after the package has been opened and allowing the spout to be used without the cap or handle being in the way.

Advantageously, the closure assembly is equipped with a guarantee seal, the broken condition of which is particularly apparent.

Advantageously, the guarantee seal of the present invention allows the user to evaluate the condition of the closure assembly. In particular, the breakable segment allows the user to easily determine whether the closure assembly has been even partially opened.

Advantageously, the breakable segment is another visible sign that determines whether the guarantee seal has been breached.

Advantageously, the breakable segment increases the resistance of the guarantee seal, avoiding the accidental breakage of said seal and the resulting opening of the closure assembly, compromising its conformity.

It is clear that a person skilled in the art, in order to satisfy current needs, could make modifications to the closure described above, said modifications all being contained within the scope of protection as defined in the following claims.

What is claimed is:

1. A closure assembly for a package with a flexible thin-walled pouch for containing fruit juices and puree, yoghurt, and energy drinks, comprising:

a spout assembly comprising a connection portion, suitable for being hermetically applied to the flexible thin-walled pouch, and a threaded spout, externally provided with a ring seat;

a closure comprising a cap assembly comprising:

a cap screwable to the threaded spout; and a guarantee seal to highlight first opening of the closure, comprising:

a guarantee ring at least partially received in the ring seat of the threaded spout;

a guarantee band which, in an unbroken seal configuration, axially overlaps the guarantee ring, separated from the guarantee ring by a first separation line and from the cap by a second separation line;

a plurality of breakable bridges which, in the unbroken seal configuration, join the guarantee ring to the guarantee band and the guarantee band to the cap;

a first attachment portion, more resistant than the breakable bridges, which joins the guarantee band to the guarantee ring and a second attachment portion, more resistant than the breakable bridges, which joins the guarantee band to the cap; and a predominantly circumferentially extending breakable segment;

wherein, in an open configuration of the closure in which the cap is unscrewed and the bridges are broken, the guarantee band forms a strap that keeps the cap fastened to the guarantee ring;

the guarantee band having a length such that, in a use configuration in which the guarantee band is stretched, the second attachment portion is axially arranged below the connection portion of the spout assembly;

wherein the guarantee band extends between an initial portion and an end portion, and, in the unbroken seal configuration, the initial portion is circumferentially adjacent to and axially aligned with the end portion; and wherein the initial portion is spaced apart from the end portion by the breakable segment, the breakable segment joining the initial portion and the end portion in the unbroken seal configuration and being broken in the open configuration.

2. The closure assembly of claim 1, wherein the first attachment portion is at the initial portion and the second attachment portion is at the end portion.

3. The closure assembly of claim 1, wherein the breakable segment is sized so as to undergo a preferential break at the initial portion.

4. The closure assembly of claim 1, wherein the breakable bridges are sized so as to undergo a preferential break at the guarantee band.

5. The closure assembly of claim 1, wherein the first separation line has a fret or wavy circumferential pattern, so as to form at least one relief of the guarantee band which, in a first screwing configuration, thrusts on a respective relief of the guarantee ring, dragging the guarantee ring in rotation.

6. The closure assembly of claim 1, wherein the guarantee ring is freely rotatable in the ring seat in the open configuration of the closure.

7. The closure assembly of claim 1, comprising locking elements that prevent or limit free rotation of the guarantee ring in the ring seat.

8. The closure assembly of claim 1, wherein the first attachment portion is sized so that, if the cap is pulled so as to cause a breakage and a separation from the spout assembly, the breakage occurs at the first attachment portion.

9. The closure assembly of claim 1, wherein the closure comprises an over-cap comprising a shell integral with the cap and an annular handle, spaced radially externally from the shell, and spokes that make the annular handle integral with the shell.

10. The closure assembly of claim 1, wherein the ring seat is delimited by a second plate and by an engagement plate, whereby a projection of the shape of the engagement plate along a spout axis on the second plate is entirely contained in the second plate.

11. A package comprising:

a thin-walled flexible pouch; and a closure assembly for a package with a flexible thin-walled pouch for containing fruit juices and puree, yoghurt, and energy drinks, comprising:

a spout assembly comprising a connection portion, suitable for being hermetically applied to the flexible thin-walled pouch, and a threaded spout, externally provided with a ring seat;

a closure comprising a cap assembly comprising:

a cap screwable to the threaded spout; and a guarantee seal to highlight first opening of the closure, comprising:

a guarantee ring at least partially received in the ring seat of the threaded spout;

a guarantee band which, in an unbroken seal configuration, axially overlaps the guarantee ring, separated from the guarantee ring by a first separation line and from the cap by a second separation line;

a plurality of breakable bridges which, in the unbroken seal configuration, join the guarantee ring to the guarantee band and the guarantee band to the cap;

a first attachment portion, more resistant than the breakable bridges, which joins the guarantee band to the guarantee ring and a second attachment portion, more resistant than the breakable bridges, which joins the guarantee band to the cap; and a predominantly circumferentially extending breakable segment;

wherein, in an open configuration of the closure in which the cap is unscrewed and the bridges are broken, the guarantee band forms a strap that keeps the cap fastened to the guarantee ring;

the guarantee band having a length such that, in a use configuration in which the guarantee band is stretched, the second attachment portion is axially arranged below the connection portion of the spout assembly;

wherein the guarantee band extends between an initial portion and an end portion, and, in the unbroken seal configuration, the initial portion is circumferentially adjacent to and axially aligned with the end portion; and wherein the initial portion is spaced apart from the end portion by the breakable segment, the breakable segment joining the initial portion and the end portion in the unbroken seal configuration and being broken in the open configuration, wherein the spout assembly of the closure assembly is hermetically applied to the thin-walled flexible pouch.

* * * * *